US012442153B2

(12) United States Patent
Zaharia et al.

(10) Patent No.: US 12,442,153 B2
(45) Date of Patent: Oct. 14, 2025

(54) DIPPER HANDLE ASSEMBLY

(71) Applicant: Caterpillar Global Mining LLC, Tucson, AZ (US)

(72) Inventors: Cristian Zaharia, Marana, AZ (US); Michael W. Haws, Wind Point, WI (US); Aruna Kinjarapu, Oro Valley, AZ (US); Vladimir A. Korchagin, Tucson, AZ (US); James G. Jamilosa, Waipahu, HI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 946 days.

(21) Appl. No.: 17/558,987

(22) Filed: Dec. 22, 2021

(65) Prior Publication Data

US 2023/0193584 A1 Jun. 22, 2023

(51) Int. Cl.

| | |
|---|---|
| ***E02F 3/36*** | (2006.01) |
| ***E02F 3/30*** | (2006.01) |
| ***E02F 3/38*** | (2006.01) |
| ***E02F 3/58*** | (2006.01) |

(52) U.S. Cl.

CPC ..... *E02F 3/3677* (2013.01); *E02F 3/303* (2013.01); *E02F 3/38* (2013.01); *E02F 3/58* (2013.01); *E02F 3/308* (2013.01)

(58) Field of Classification Search

CPC ..... E02F 3/30; E02F 3/52; E02F 3/54; E02F 3/26; E02F 3/28; E02F 3/42; E02F 9/14

See application file for complete search history.

(56) References Cited

U.S. PATENT DOCUMENTS

| | | | | |
|---|---|---|---|---|
| 8,984,779 | B2 * | 3/2015 | Knuth | E02F 3/40 37/396 |
| 9,009,994 | B2 | 4/2015 | Hren et al. | |
| 10,094,090 | B2 | 10/2018 | Knuth | |
| 10,156,053 | B2 | 12/2018 | Hren | |

(Continued)

FOREIGN PATENT DOCUMENTS

| | | | |
|---|---|---|---|
| AU | 2021106138 | 10/2021 | |
| AU | 2021106138 C4 * | 1/2024 | E02F 3/304 |

(Continued)

OTHER PUBLICATIONS

Written Opinion and International Search Report for Int'l. Patent Appln. No. PCT/US2022/052767, mailed Apr. 27, 2023 (9 pgs).

*Primary Examiner* — Christopher J Sebesta
*Assistant Examiner* — Audrey L Lusk

(57) ABSTRACT

A yoke of a dipper handle comprises a collar and a crowd pin aperture extending along a crowd pin aperture axis. First and second arms of the yoke include dipper pin lug apertures aligned along a dipper pin aperture axis parallel to the crowd pin aperture axis. The first and second arms of the yoke further include first and second pitch brace lug apertures aligned along a pitch brace aperture axis parallel to the crowd pin aperture axis. A first virtual reference line extends between the crowd pin aperture axis and the dipper pin aperture axis, while a second virtual reference line extends between the crowd pin aperture axis and the pitch brace aperture axis. An included angle α between the first virtual reference line and the second virtual reference line is between approximately 25 to approximately 51 degrees.

20 Claims, 10 Drawing Sheets

(56) References Cited

U.S. PATENT DOCUMENTS

| | | | | |
|---|---|---|---|---|
| 10,538,896 | B2 | 1/2020 | Trotnow et al. | |
| 10,718,097 | B2 | 7/2020 | Hren et al. | |
| 10,865,541 | B1 | 12/2020 | Rhodine et al. | |
| 10,920,393 | B2 | 2/2021 | Hren et al. | |
| 2003/0126772 | A1 | 7/2003 | Masumoto et al. | |
| 2013/0259625 | A1* | 10/2013 | Hren | E02F 9/14 414/722 |
| 2013/0280021 | A1 | 10/2013 | Knuth | |
| 2014/0205415 | A1 | 7/2014 | Bienfang et al. | |
| 2015/0147146 | A1 | 5/2015 | Hren et al. | |
| 2017/0089044 | A1* | 3/2017 | Chitty | G01M 5/0033 |
| 2018/0038064 | A1 | 2/2018 | Jung | |
| 2021/0095436 | A1* | 4/2021 | Rhodine | E02F 3/3677 |

FOREIGN PATENT DOCUMENTS

| | | | |
|---|---|---|---|
| CN | 204608855 | U | 9/2015 |
| JP | 2008045303 | A | 2/2008 |

* cited by examiner

DIPPER HANDLE ASSEMBLY

TECHNICAL FIELD

The present disclosure relates to dipper handle assemblies and, more particularly, to a work machine having a dipper handle assembly.

BACKGROUND

Power shovels are in a category of excavation equipment used to remove large amounts of overburden and ore during a mining operation. One type of power shovel is known as a rope shovel. A rope shovel includes a boom, a dipper handle assembly pivotally connected to a mid-point of the boom, and a bucket (also known as a dipper) pivotally connected at one end of the dipper handle assembly. A cable extends over a sheave at a distal end of the boom and terminates at the dipper. The cable is reeled in or spooled out by electric, hydraulic, and/or mechanical motors to selectively raise and lower the dipper.

More specifically, the dipper handle assembly includes a tube that is coupled to the boom and a yoke coupled to the dipper. In some applications, the scale of the power shovel is such that the handle assembly alone weighs on the order of 20 tons or more. During a digging operation, as the dipper engages the overburden and ore, the yoke and tube may experience significant stresses over time that can lead to cracking or weld failure.

One attempt to improve durability of the dipper handle assembly is disclosed in U.S. Pat. No. 10,865,541 issued to Rhodine et al. on Dec. 15, 2020 ("the '541 patent"). Specifically, the '541 patent discloses a yoke for a dipper handle having a transition portion formed, at least in part, of a forged metal. Although the yoke of the '541 patent may have improved strength by eliminating material defects inherent in casting processes, further improvement in strength characteristics of the dipper handle assembly would be advantageous.

SUMMARY OF THE DISCLOSURE

In one aspect of the present disclosure, a dipper handle assembly includes a tube, and a yoke coupled to the tube. The yoke comprises a collar extending along a collar axis, wherein a crowd pin aperture extends through the collar along a crowd pin aperture axis normal to the collar axis, and a transition portion coupled to the collar. A first arm of the yoke comprises a first arm proximal end coupled to the transition portion and a first arm distal end spaced from the first arm proximal end, a first dipper pin lug disposed adjacent the first arm distal end and defining a first dipper pin lug aperture, and a first pitch brace lug located intermediate the first arm proximal end and the first arm distal end and defining a first pitch brace lug aperture. A second arm of the yoke comprises a second arm proximal end coupled to the transition portion and a second arm distal end spaced from the second arm proximal end, wherein the second arm is spaced from the first arm, a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis, and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis. A first virtual reference line extends between the crowd pin aperture axis and the dipper pin aperture axis, while a second virtual reference line extends between the crowd pin aperture axis and the pitch brace aperture axis. An included angle $\alpha$ between the first virtual reference line and the second virtual reference line is between approximately 25 to approximately 51 degrees.

In another aspect of the disclosure, a work machine comprises a base configured to be supported on a ground surface, a revolving frame coupled to the base and rotatable about an axis, a boom pivotally coupled to the revolving frame, and a dipper handle assembly pivotally coupled to the boom. The dipper handle assembly comprises a tube and a yoke coupled to the tube. The yoke comprises a collar extending along a collar axis, wherein a crowd pin aperture extends through the collar along a crowd pin aperture axis normal to the collar axis, and a transition portion coupled to the collar. A first arm of the yoke comprises a first arm proximal end coupled to the transition portion and a first arm distal end spaced from the first arm proximal end, a first dipper pin lug disposed adjacent the first arm distal end and defining a first dipper pin lug aperture, and a first pitch brace lug located intermediate the first arm proximal end and the first arm distal end and defining a first pitch brace lug aperture. A second arm of the yoke comprises a second arm proximal end coupled to the transition portion and a second arm distal end spaced from the second arm proximal end, wherein the second arm is spaced from the first arm, a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis, and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis. A first virtual reference line extends between the crowd pin aperture axis and the dipper pin aperture axis, while a second virtual reference line extends between the crowd pin aperture axis and the pitch brace aperture axis. An included angle $\alpha$ between the first virtual reference line and the second virtual reference line is between approximately 25 to approximately 51 degrees.

In yet another aspect of the disclosure, a method is disclosed of retrofitting a work machine having an existing dipper handle assembly with a replacement dipper handle assembly. The method comprises removing the existing dipper handle assembly. The method continues with providing the replacement dipper handle assembly with a tube and a yoke coupled to the tube. The yoke comprises a collar extending along a collar axis, wherein a crowd pin aperture extends through the collar along a crowd pin aperture axis normal to the collar axis, and a transition portion coupled to the collar. A first arm of the yoke comprises a first arm proximal end coupled to the transition portion and a first arm distal end spaced from the first arm proximal end, a first dipper pin lug disposed adjacent the first arm distal end and defining a first dipper pin lug aperture, and a first pitch brace lug located intermediate the first arm proximal end and the first arm distal end and defining a first pitch brace lug aperture. A second arm of the yoke comprises a second arm proximal end coupled to the transition portion and a second arm distal end spaced from the second arm proximal end, wherein the second arm is spaced from the first arm, a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis, and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis. A first virtual reference line extends between the crowd pin aperture axis and the dipper pin aperture axis, while a second virtual reference line extends between the crowd pin aperture axis and the pitch brace aperture axis. An included angle $\alpha$ between the first virtual reference line and the second virtual reference line is between approximately 25 to approximately 51 degrees. The method further includes coupling the replacement dipper handle assembly to the work machine.

DETAILED DESCRIPTION

Figure 1:
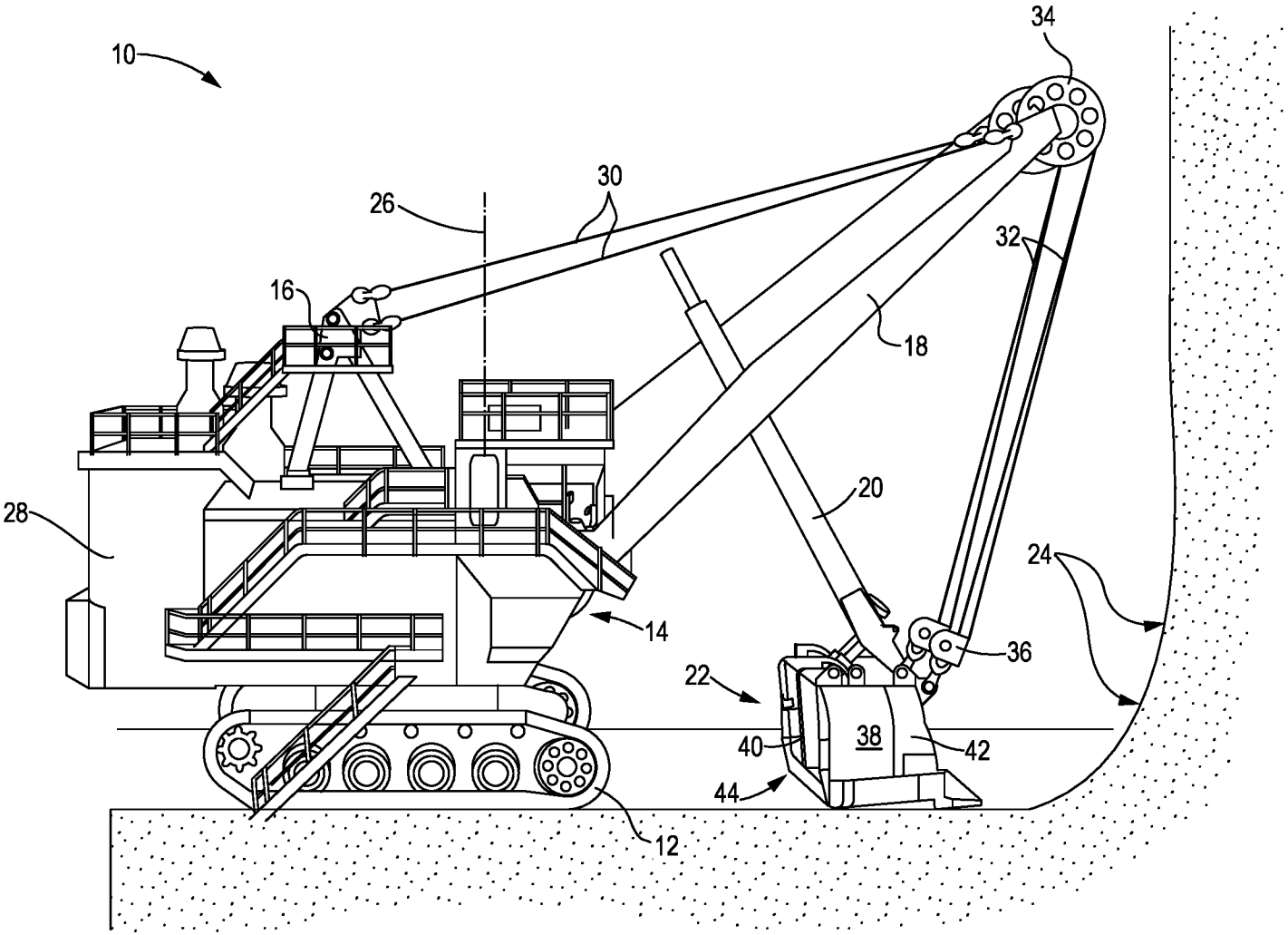
FIG. 1 is a diagrammatic illustration of an exemplary disclosed work machine.
Figure 2:
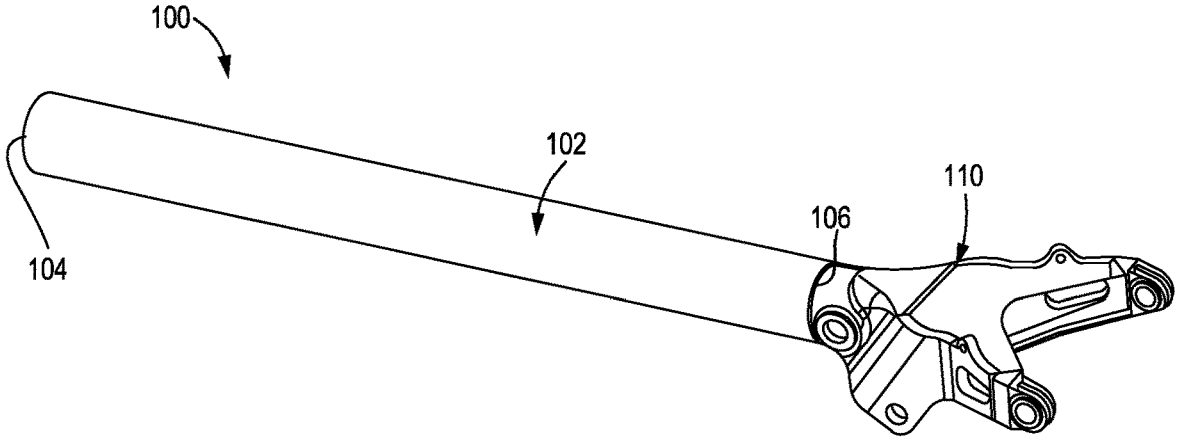
FIG. 2 is an enlarged, perspective view of a dipper handle assembly associated with the work machine of FIG. 1.

FIG. 1 illustrates an exemplary embodiment of a work machine 10. Work machine 10 may perform any type of operation associated with an industry such as mining, construction, excavation, or any other industry known in the art. For example, work machine 10 may embody an earth moving machine such as the power shovel depicted in FIG. 1. In the exemplary embodiment of FIG. 1, work machine 10 may include a base 12, a body 14 operatively connected to base 12, a gantry member 16 rigidly mounted to a top side of body 14 opposite base 12, a boom 18 pivotally connected to a leading end of body 14, a dipper handle assembly 20 pivotally connected to a midpoint of boom 18, a tool 22 pivotally connected to a distal end of dipper handle assembly 20, and cabling connecting gantry member 16, boom 18, dipper handle assembly 20, and tool 22.

Base 12 may be a structural unit that supports movements of work machine 10. In the disclosed exemplary application, base 12 is itself movable, having one or more traction devices such as feet, tracks (shown in FIG. 1), and/or wheels that are driven to propel machine 10 over a work surface 24. In other applications, however, base 12 may be a stationary platform configured for fixed engagement with work surface 24.

Body 14 may pivot relative to base 12. Specifically, body 14 may pivot relative to base 12 about a substantially vertical axis 26. As body 14 is pivoted about axis 26, attached gantry member 16, boom 18, dipper handle assembly 20, and tool 22 may likewise pivot to change a radial engagement angle of tool 22 with work surface 24. In the exemplary embodiment of FIG. 1, tool 22 typically engages with the vertical portion of work surface 24, and the horizontal portion of work surface 24 may be formed as a result of such engagement. The vertical portion of work surface 24 may be removed by tool 22 in subsequent passes and/or by additional machines located proximate work surface 24. Body 14 may house, among other things, a power source 28 that powers the movements of work machine 10.

Gantry member 16 may be a structural frame member, for example a general A-frame member, that is configured to anchor one or more cables 30 to body 14. Gantry member 16 may extend from body 14 in a vertical direction away from base 12. Gantry member 16 may be located rearward of boom 18 relative to tool 22 and, in the disclosed exemplary embodiment, fixed in a single orientation and position. Cables 30 may extend from an apex of gantry member 16 to a distal end of boom 18, thereby transferring a weight of boom 18, tool 22, and a load contained within tool 22 into body 14.

Boom 18 may be pivotally connected at a base end to body 14, and constrained at a desired vertical angle relative to work surface 24 by cables 30. Additional cables 32 may extend from body 14 over a sheave mechanism 34 located at the distal end of boom 18 and around a sheave mechanism 36 of tool 22. Cables 32 may connect tool 22 to body 14 by way of one or more motors and/or transmissions coupled to a drum (not shown), such that a rotation of the motors (and/or transmissions coupled to a drum) functions to reel in or spool out cables 32. The reeling in and spooling out of cables 32 may affect the height and angle of tool 22 relative to work surface 24. For example, when cables 32 are reeled in, the decreasing effective length of cables 32 may cause tool 22 to rise and tilt backward away from work surface 24. In contrast, when cables 32 are spooled out, the increasing effective length of cables 32 may cause tool 22 to lower and tilt forward toward work surface 24.

Dipper handle assembly 20 may be pivotally connected at one end to a general midpoint of boom 18, and at an opposing end to a corner of tool 22 adjacent sheave mechanism 36 (e.g., rearward of sheave mechanism 36). In this position, dipper handle assembly 20 may function to maintain a desired distance of tool 22 away from boom 18 and ensure that tool 22 moves through a desired arc as cables 32 are reeled in and spooled out. In the disclosed embodiment, dipper handle assembly 20 may be connected to boom 18 at a location closer to the base end of boom 18, although other configurations are also possible. In some configurations, dipper handle assembly 20 may be provided with a crowd cylinder (not shown) that functions to extend or retract dipper handle assembly 20. In this manner, the distance between tool 22 and boom 18 (as well as the arcuate trajectory of tool 22) may be adjusted.

Tool 22, in the exemplary embodiments of the present disclosure, is known as a "dipper," and the terms "tool 22" and "dipper" may be used interchangeably throughout this disclosure. A dipper is a type of shovel bucket having a dipper body 38, and a dipper door 40 located at a back side of dipper body 38 opposite a front side excavation opening 42. Dipper door 40 may be hinged along a base edge at the back side of dipper body 38, so that it can be selectively pivoted to open and close dipper body 38 during an excavating operation. Dipper door 40 may be pivoted between the open and closed positions by gravity, and held closed or released by way of an actuator system 44. For example, when tool 22 is lifted upward toward the distal end of boom 18 by reeling in of cables 32, a releasing action of actuator system 44 may allow the weight of dipper door 40 (and any material within tool 22) to swing dipper door 40 downward toward work surface 24 and away from dipper body 38. This motion may allow material collected within tool 22 to spill out the back side of dipper body 38. In contrast, when tool 22 is lowered toward work surface 24, the weight of dipper door 40 may cause dipper door 40 to swing back toward dipper body 38. Actuator system 44 may then be caused to lock dipper door 40 in its closed position.

In the disclosed embodiments, actuator system 44 may be remotely controlled, such as by way of an electric signal, a hydraulic signal, a pneumatic signal, a radio signal, a wireless signal, or another type of signal known in the art. It is contemplated, however, that a cable may alternatively be mechanically connected to and used to activate actuator system 44, if desired.

FIGS. 2-6 illustrate a first example of a dipper handle assembly 100, for use with the work machine 10, having a shape and using materials that advantageously improve strength characteristics of the assembly. The dipper handle assembly 100 includes a tube 102 having a tube first end 104 and a tube second end 106. The tube 102 may be pivotally coupled to a midpoint of the boom 18.

Figure 4:
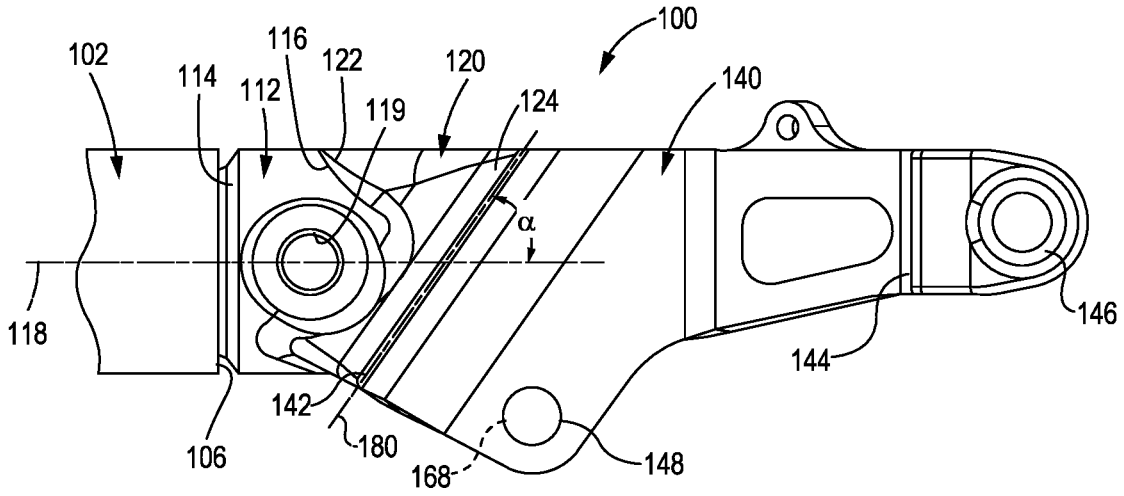
FIG. 4 is an enlarged, side elevation view of the yoke end of the dipper handle assembly of FIG. 2.

The dipper handle assembly 100 further includes a yoke 110 that is coupled to the tube 102, and which carries the dipper 22. More specifically, the yoke 110 includes a collar 112 having a collar proximal end 114 coupled to the tube second end 106, and a collar distal end 116 opposite the collar proximal end 114, as best shown in FIG. 4. The collar 112 may have a cylindrical shape extending along a collar axis 118. The collar proximal end 114 is shown abutting the tube second end 106, while the collar distal end 116 is approximately located adjacent a crowd pin aperture 119.

Figure 5:
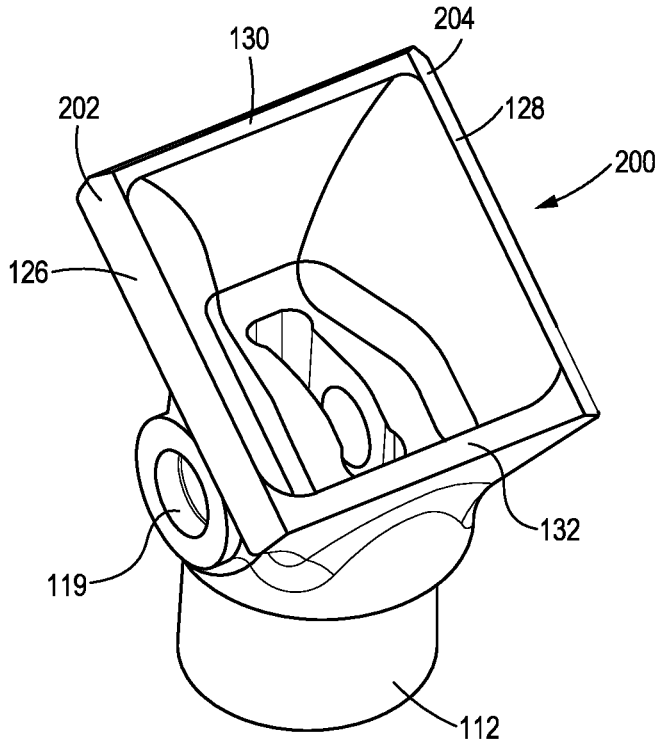
FIG. 5 is an enlarged, perspective view of a transition portion of the dipper handle assembly of FIG. 2.
Figure 6:
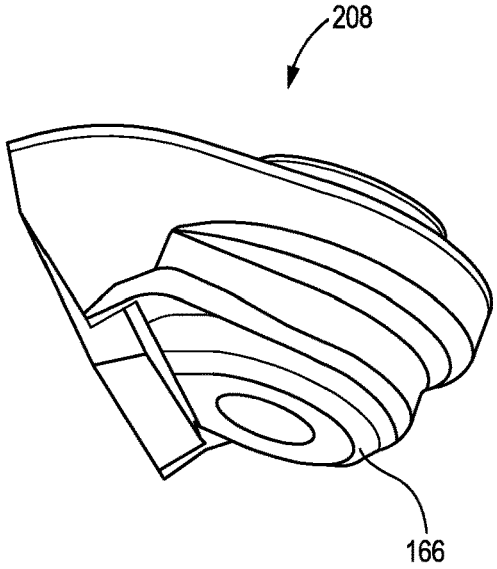
FIG. 6 is an enlarged, perspective view of a dipper pin lug provided on the dipper handle assembly of FIGS. 2-5.

The yoke 110 further includes a transition portion 120 coupled to, and generally extending outward from, the collar 112. As best shown in FIGS. 2-5, the transition portion 120 includes a transition portion proximal end 122 coupled to the collar distal end 116, and a transition portion distal end 124 opposite the transition portion proximal end 122. The transition portion 120 extends laterally outwardly relative to the collar axis 118 from the transition portion proximal end 122 to the transition portion distal end 124. The transition portion distal end 124 includes spaced first and second lateral sections 126, 128 joined by spaced first and second transverse sections 130, 132, as best shown in FIG. 5.

The yoke 110 further includes first and second arms 140, 160 coupled to the transition portion 120, which are provided to support the dipper 22. The first arm 140 includes a first arm proximal end 142 coupled to the first lateral section 126 of the transition portion distal end 124, and a first arm distal end 144 spaced from the first arm proximal end 142. A first dipper pin lug 146 is disposed adjacent the first arm distal end 144, and a first pitch brace lug 148 is located intermediate the first arm proximal end 142 and the first arm distal end 144. Similarly, the second arm 160 includes a second arm proximal end 162 coupled to the second lateral section 128 of the transition portion distal end 124, and a second arm distal end 164 spaced from the second arm proximal end 162. A second dipper pin lug 166 disposed adjacent the second arm distal end 164, and a second pitch brace lug 168 is located intermediate the second arm proximal end 162 and the second arm distal end 164.

Figure 3:
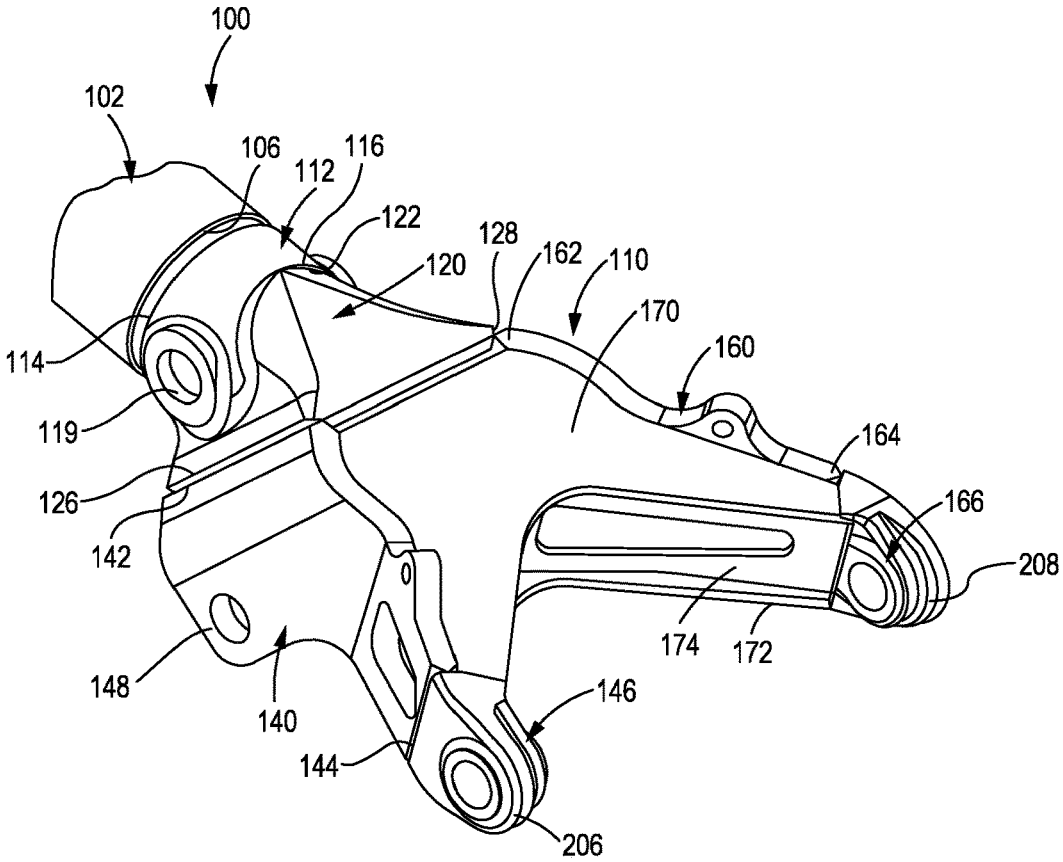
FIG. 3 is an enlarged perspective view of a yoke end of the dipper handle assembly of FIG. 2.

The yoke 110 further may include additional components for maintaining structural integrity. For example, as best shown at FIG. 3, upper and lower plates 170, 172 may be provided between the first and second arms 140, 160. Additionally, one or more cross-braces 174 may also interconnect between the first and second arms 140, 160.

The shape of the yoke 110 where the transition portion 120 meets the first and second arms 140, 160 is configured to reduce stresses on the yoke 110 during operation. As best shown in FIG. 4, the first and second lateral sections 126, 128 and the first and second transverse sections 130, 132 of the transition portion distal end 124 advantageously lie in a virtual transition portion distal end plane 180 that intersects the collar axis 118 at an oblique angle $\alpha$. By providing the transition portion distal end 124 at the angle $\alpha$, the yoke 110 is better able to withstand stresses generated as the dipper 22 engages the work surface 24.

The various portions of the yoke 110 may be formed independently as separate components, or two or more portions may be integrally formed as a composite component. Furthermore, the separate components and/or composite components may be formed of different materials, as discussed more fully below.

In the example illustrated at FIGS. 2-6, the collar 112 and the transition portion 120 are integrally provided as a transition component 200, while each of the first and second arms 140, 160 and first and second dipper pin lugs 146, 166 are provided as separate components. More specifically, the first lateral section 126 of the transition portion distal end 124 defines a first interface surface 202 configured for coupling to the first arm 140, while the second lateral section 128 of the transition portion distal end 124 defines a second interface surface 204 configured for coupling to the second arm 160. The first dipper pin lug 146 comprises a first dipper pin lug component 206 formed independent of the first arm 160, and the second dipper pin lug 166 comprises a second dipper pin lug component 208 formed independent of the second arm 160. In this example, each of the transition component 200, first dipper pin lug component 206, and second dipper pin lug component 208 may comprise forged metal, while the first and second arms 140, 160 may comprise forged metal or, alternatively, non-forged metal.

Figure 7:
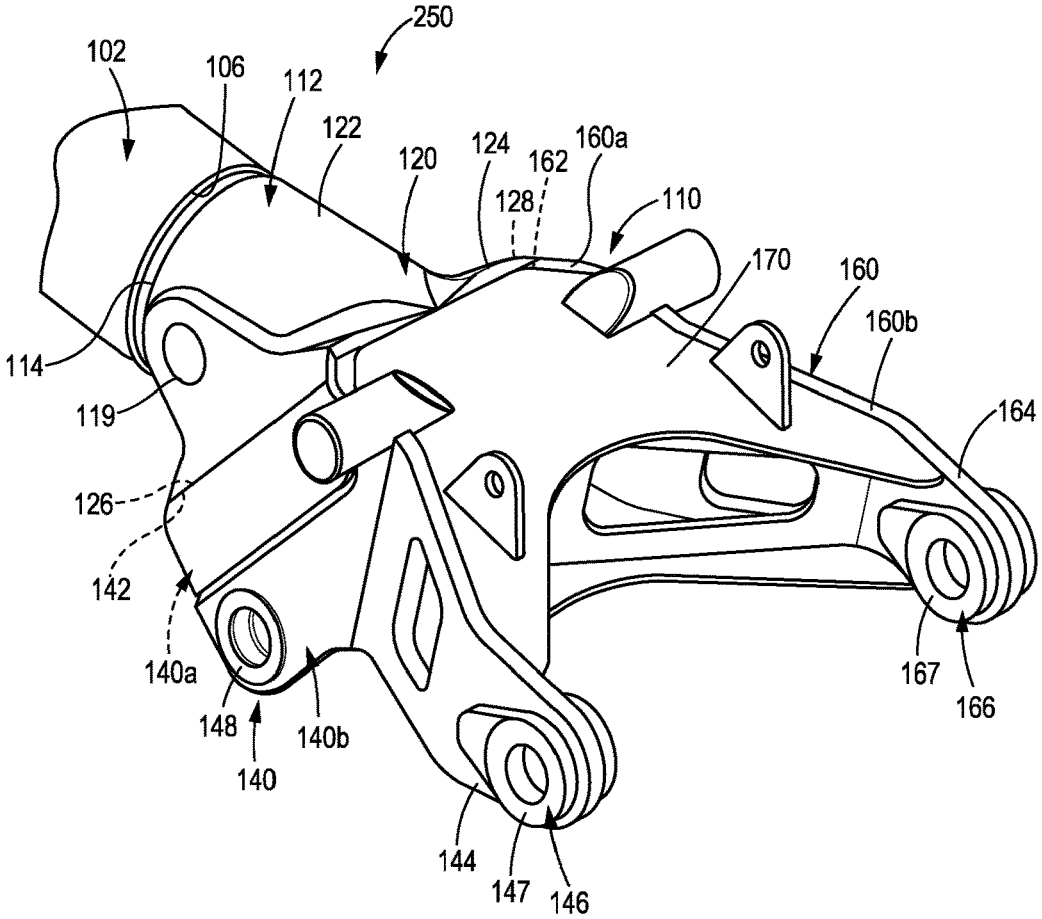
FIG. 7 is an enlarged, perspective view of another embodiment of a dipper handle assembly associated with the work machine of FIG. 1.
Figure 8:
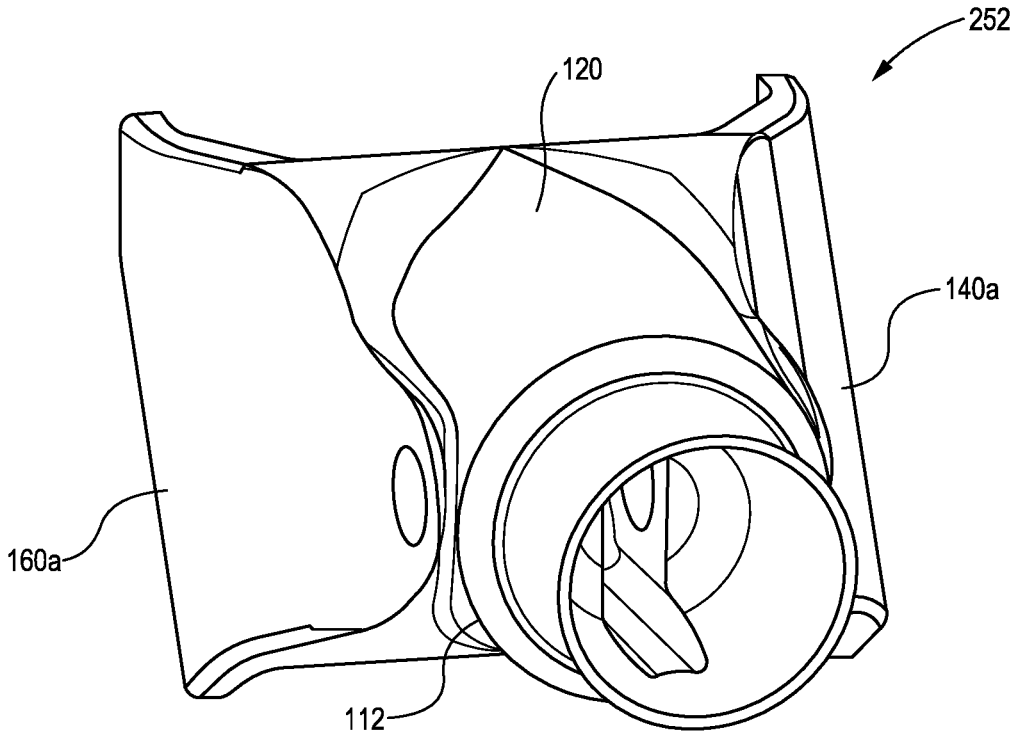
FIG. 8 is an enlarged, perspective view of a transition portion of the dipper handle assembly of FIG. 7.
Figure 9:
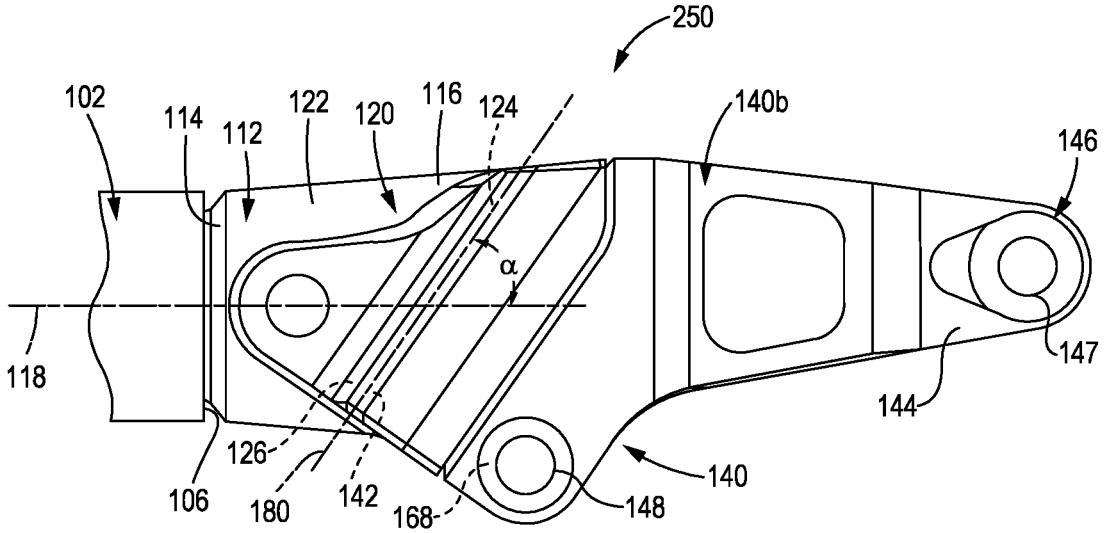
FIG. 9 is an enlarged, side elevation view of a yoke end of the dipper handle assembly of FIG. 7.

FIGS. 7-9 illustrate a second example of a dipper handle assembly 250 for use in the work machine 10. The dipper handle assembly 250 of FIGS. 7-9 is similar to the dipper handle assembly 100 of FIGS. 2-6, and therefore like reference numbers are used for like parts as appropriate. The primary differences between the dipper handle assembly 100 and the dipper handle assembly 250 are the portions that are provided integrally as composite components and the portions that are provided independently as separate components.

More specifically, portions of the first and second arms 140, 160 are provided on separate components. The first arm 140 includes a first arm proximal section 140*a* including the first arm proximal end 142, and a first arm distal section 140*b* coupled to the first arm proximal section 140*a* and including the first arm distal end 144. Similarly, the second arm 160 includes a second arm proximal section 160*a* including the second arm proximal end 162, and a second arm distal section 160*b* coupled to the second arm proximal end 160*a* and including the second arm distal end 164. In this example, the collar 112, transition portion 120, first arm proximal section 140*a*, and second arm proximal section 160*a* are integrally provided as a transition component 252, as best shown at FIG. 8. The first arm distal section 140*b* and second arm distal section 160*b* are formed as separate components that are coupled, respectively, to the first arm proximal section 140*a* and the second arm proximal section 160*a*.

Similar to the dipper handle assembly 100 described above, the transition component 252 of the dipper handle assembly 250 includes the transition portion distal end 124. Furthermore, as best shown in FIG. 9, the transition portion distal end 124 advantageously lies in a virtual transition portion distal end plane 180 that intersects the collar axis 118 at an oblique angle α.

In the example of the dipper handle assembly 250 illustrated in FIGS. 7-9, the lugs are provided as inserts coupled to the first and second arms 140, 160. More specifically, the first dipper pin lug 146 comprises a first dipper pin lug insert 147 coupled to the first arm distal section 140*b*, while the second dipper pin lug 166 comprises a second dipper pin lug insert 167 coupled to the second arm distal section 160*b*. Each of the transition component 252, first dipper pin insert 147, and second dipper pin lug insert 167 may comprise forged metal, while each of the first arm distal section 140*b* and second arm distal section 160*b* may comprise forged metal or, alternatively, non-forged metal.

FIGS. 10-13 illustrate a further example of a dipper handle assembly 300 for use in the work machine 10. The dipper handle assembly 300 of FIGS. 10-13 is similar to the dipper handle assembly 100 of FIGS. 2-6 and the dipper handle assembly 250 of FIGS. 7-9, and therefore like reference numbers are used for like parts as appropriate. The primary differences between the dipper handle assembly 300 and the dipper handle assemblies 100, 250 are the portions that are provided integrally as composite components.

Figure 10:
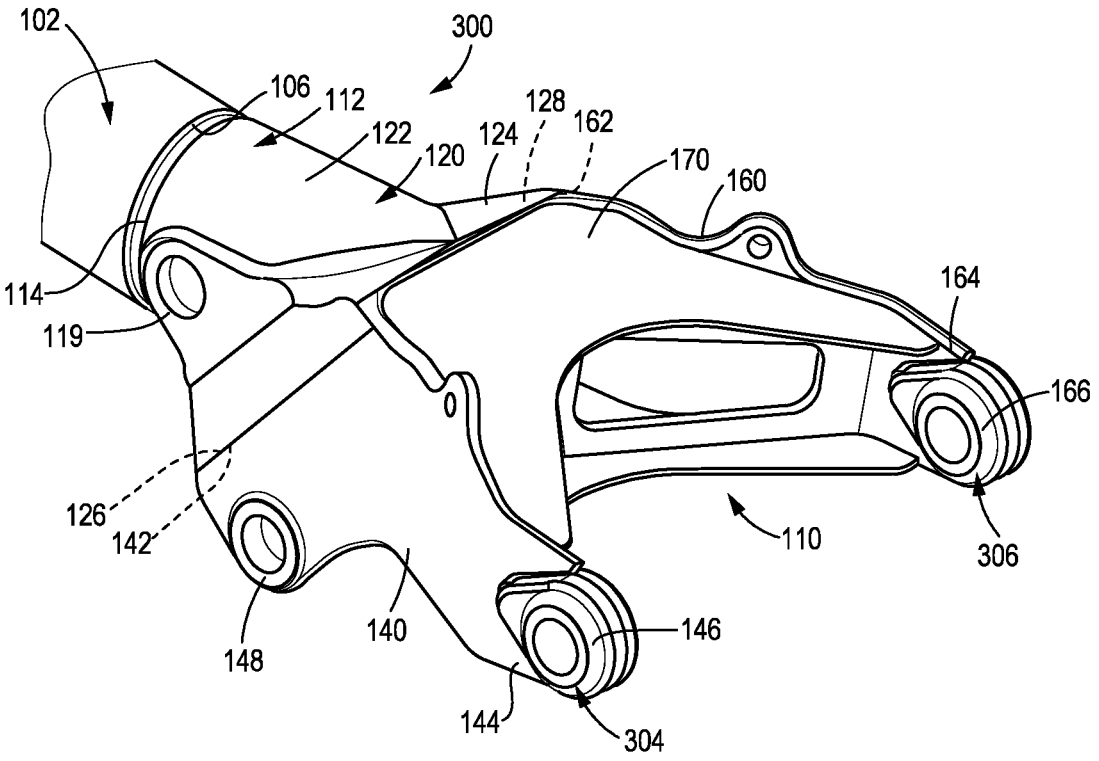
FIG. 10 is an enlarged, perspective view of yet another embodiment of a dipper handle assembly associated with the work machine of FIG. 1.
Figure 11:
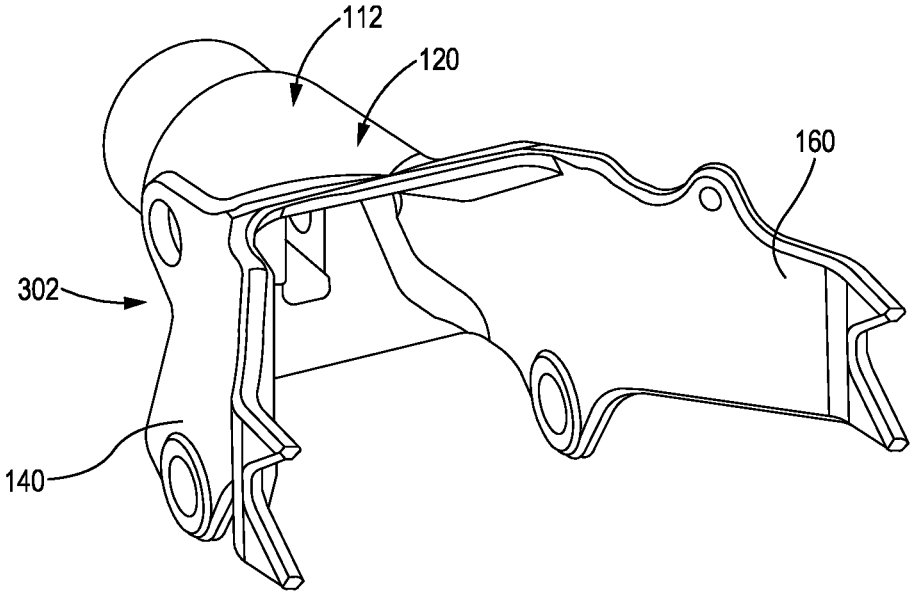
FIG. 11 is an enlarged, perspective view of a yoke and transition portion of the dipper handle assembly of FIG. 10.
Figure 13:
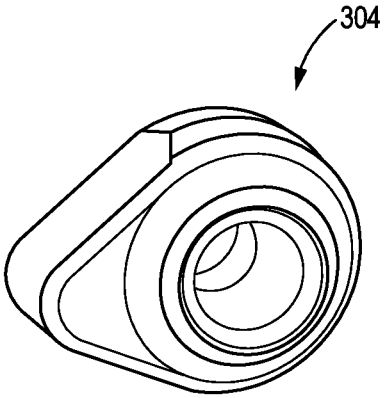
FIG. 13 is an enlarged, perspective view of a dipper pin lug insert provided on the dipper handle assembly of FIG. 10.

More specifically, the dipper handle assembly 300 includes the collar 112, transition portion 120, first arm 140, and second arm 160 that are integrally formed as a yoke component 302, as best shown in FIG. 11. The first dipper pin lug 146 comprises a first dipper pin lug insert 304 coupled to the first arm distal end 144, while the second dipper pin lug 166 comprises a second dipper pin lug insert 306 coupled to the second arm distal end 164, as best shown in FIGS. 10 and 13. Each of the yoke component 302, first dipper pin lug insert 304, and second dipper pin lug insert 306 may comprise forged metal.

Figure 12:
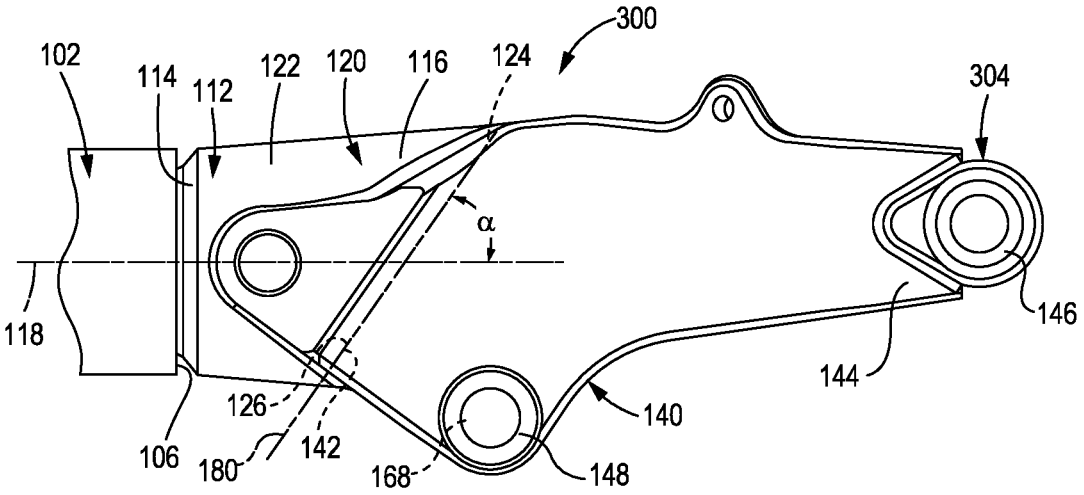
FIG. 12 is an enlarged, side elevation view of a yoke end of the dipper handle assembly of FIG. 10.

Similar to the dipper handle assemblies 100, 250 described above, the transition portion 120 of the yoke component 302 of the dipper handle assembly 300 includes the transition portion distal end 124. Furthermore, as best shown in FIG. 12, the transition portion distal end 124 advantageously lies in a virtual transition portion distal end plane 180 that intersects the collar axis 118 at an oblique angle α.

Figure 14:
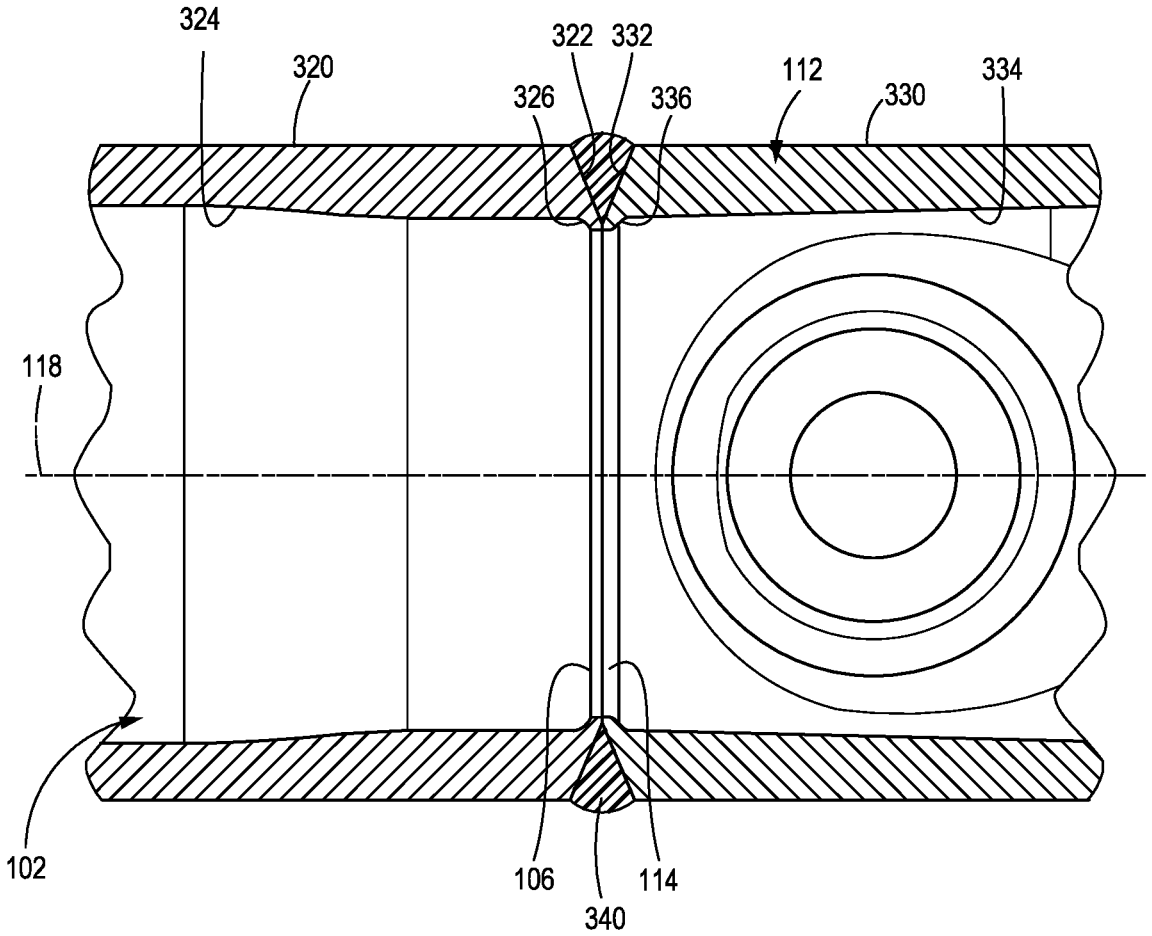
FIG. 14 is an enlarged, side elevation view, in cross-section, of a welded joint between a tube and a yoke of a dipper handle assembly.

In any of the examples disclosed herein, the connection between the tube 102 and the collar 112 may be configured to improve strength characteristics. As best shown in FIG. 14, the tube second end 106 includes a tube exterior surface 320 defining a tube exterior surface chamfer 322, and a tube interior surface 324 including a tube root extension 326 extending inwardly toward the collar axis 118. The collar proximal end 114 similarly includes a collar exterior surface 330 defining a collar exterior surface chamfer 332, and a collar interior surface 334 including a collar root extension 336 extending inwardly toward the collar axis 118. The tube second end 106 is joined to the collar proximal end 114 by a weld 340 disposed in the tube exterior surface chamfer 322 and the collar exterior surface chamfer 332.

Figure 15:
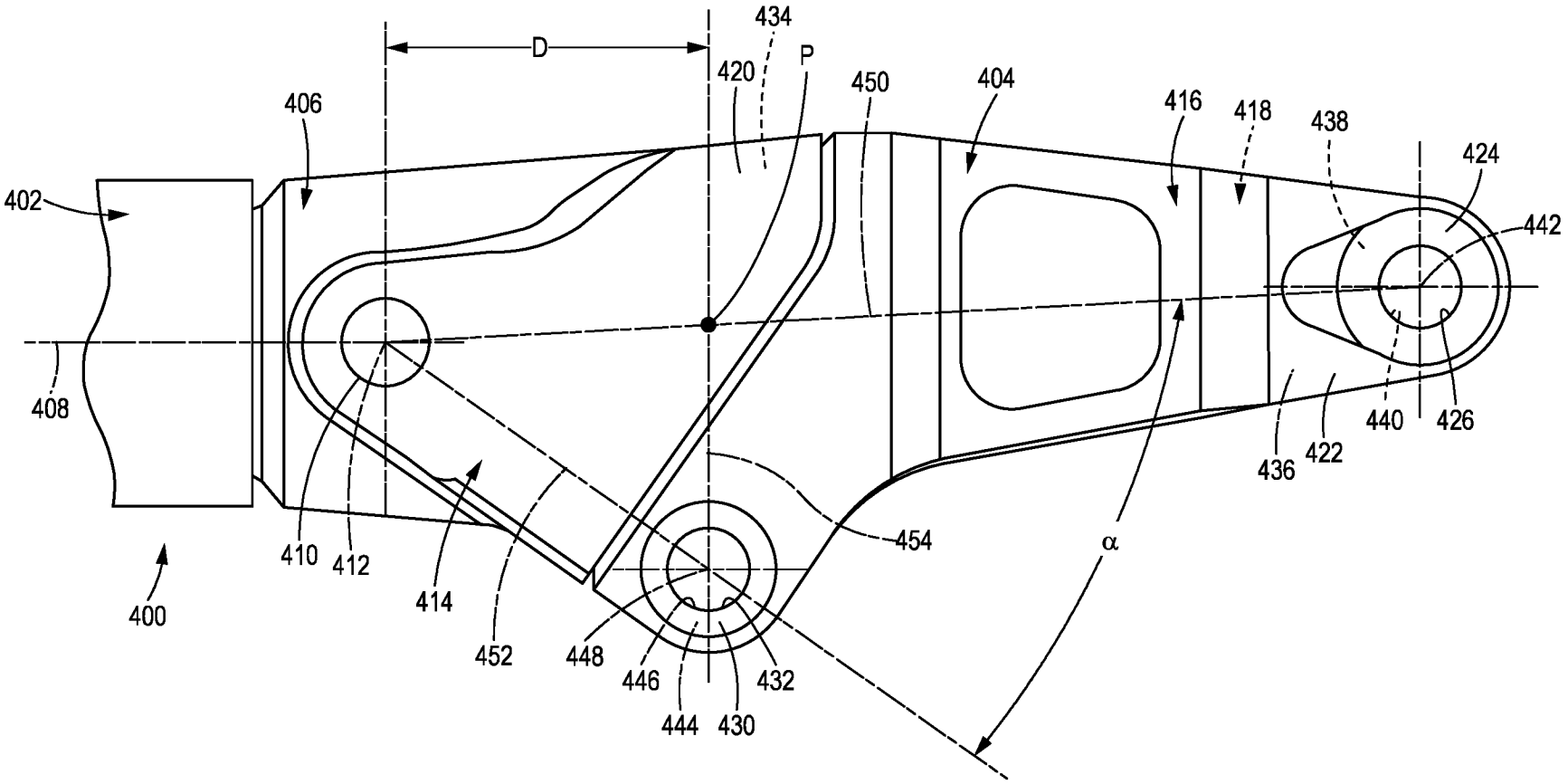
FIG. 15 is an enlarged, side elevation view of a yoke end of a dipper handle assembly, including virtual reference lines illustrating a position of a pitch brace lug aperture axis relative to a crowd pin aperture axis.

FIG. 15 is an enlarged view of an exemplary dipper handle assembly 400. In order to provide the dipper handle assembly 400 with improved strength characteristics, the inventors have identified parameters for locating a pitch brace aperture relative to a crowd pin aperture and a dipper pin aperture. The parameters identify locations for the pitch brace aperture that reduce stresses in the dipper handle assembly during operation.

More specifically, the dipper handle assembly 400 includes a tube 402. A yoke 404 is coupled to the tube 402, and includes a collar 406 extending along a collar axis 408. A crowd pin aperture 410 extends through the collar 406 along a crowd pin aperture axis 412 normal to the collar axis 408. The yoke 404 further includes a transition portion 414 coupled to the collar 406, and spaced first and second arms 416, 418.

The first arm 416 has a first arm proximal end 420 coupled to the transition portion 414 and a first arm distal end 422 spaced from the first arm proximal end 420. A first dipper pin lug 424 is disposed adjacent the first arm distal end 422 and defines a first dipper pin lug aperture 426. The first arm 416 further includes a first pitch brace lug 430 located intermediate the first arm proximal end 420 and the first arm distal end 422, wherein the first pitch brace lug 430 defines a first pitch brace lug aperture 432.

The second arm 418 has a second arm proximal end 434 coupled to the transition portion 414 and a second arm distal end 436 spaced from the second arm proximal end 434. A second dipper pin lug 438 is disposed adjacent the second arm distal end 436 and defines a second dipper pin lug aperture 440, wherein the first dipper pin lug aperture 426 and the second dipper pin lug aperture 440 are aligned along a dipper pin aperture axis 442 extending parallel to the crowd pin aperture axis 412. The second arm 418 further includes a second pitch brace lug 444 located intermediate the second arm proximal end 434 and the second arm distal end 436, wherein the second pitch brace lug 444 defines a second pitch brace lug aperture 446. The first pitch brace lug aperture 432 and the second pitch brace lug aperture 446 are disposed along a pitch brace aperture axis 448 extending parallel to the crowd pin aperture axis 412.

With continued reference to FIG. 15, a first virtual reference line 450 extends between the crowd pin aperture axis 412 and the dipper pin aperture axis 442. Additionally, a second virtual reference line 452 extends between the crowd pin aperture axis 412 and the pitch brace aperture axis 448. In a first parameter identified by the inventors, an included angle α between the first virtual reference line 450 and the second virtual reference line 452 is used to identify locations of the first and second pitch brace lugs 430, 444 relative to the crowd pin aperture axis 412. In a first example, the included angle α is between approximately 25 to approximately 51 degrees. In a second example, the included angle α is approximately 33 to approximately 43 degrees. In a third example, the included angle α is approximately 38 degrees.

With further reference to FIG. 15, a third virtual reference line 454 intersects the pitch brace aperture axis 448 and is perpendicular to the first virtual reference line 450. The third virtual reference line 454 intersects the first virtual reference line 450 at a point P. In a second parameter identified by the inventors, a distance D between the crowd pin aperture axis 412 and the point P is used to identify locations of the first and second pitch brace lugs 430, 444 relative to the crowd pin aperture axis 412. In a first example, the distance D is between approximately 520 and 1420 millimeters. In a second example, the distance D is between approximately 820 and approximately 1020 millimeters. In a third example, the distance D is approximately 920 millimeters.

As used herein, "virtual" means having the attributes of an entity without possessing its physical form. For example, a virtual reference plane is an intangible or imaginary plane, rather than a physical one, with respect to which, e.g., location and/or orientation of other physical and/or intangible entities is defined.

INDUSTRIAL APPLICABILITY

In practice, a dipper handle assembly is provided with improved strength characteristics. In some examples, the dipper handle assembly is provided with a transition portion distal end 124 that lies in a virtual transition portion distal end plane 180 that intersects the collar axis 118 at an oblique angle α, thereby to better distribute stresses experience during operation. In other examples, the pitch brace apertures are located relative to the crowd pin aperture and the dipper pin aperture within certain parameters described above, thereby to reduce stresses in the dipper handle assembly during operation. The dipper handle assemblies described herein may be sold, bought, manufactured or otherwise obtained in an OEM (original equipment manufacturer) or after-market context. In some cases, the dipper handle assembly may be provided as a kit to repair or retrofit a work machine in the field.

Figure 16:
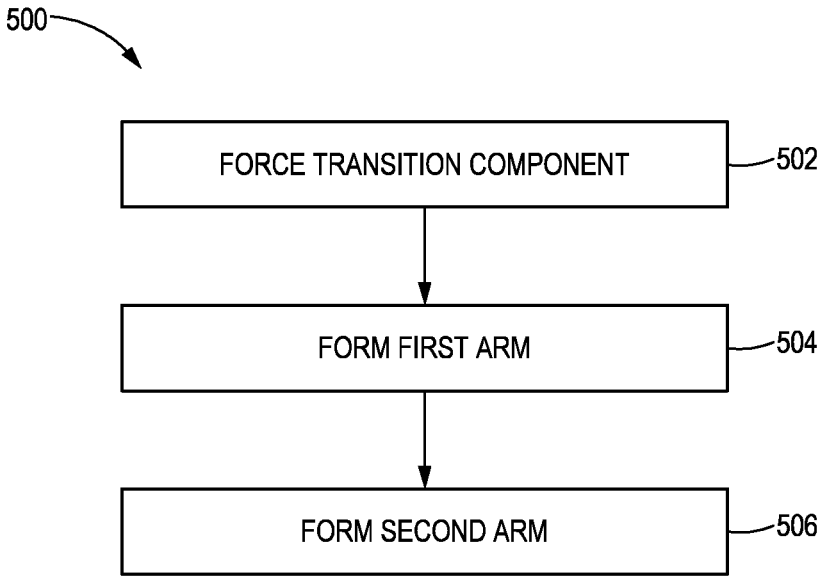
FIG. 16 is a schematic block diagram of a method of forming a yoke for a dipper handle assembly.

FIG. 16 depicts a method 500 of forming a yoke for a dipper handle assembly. The method 500 includes, at block 502, forging a transition component. The transition component includes a collar, having a collar proximal end and a collar distal end opposite the collar proximal end, which extends along a collar axis. The transition component further includes a transition portion including a transition portion proximal end, coupled to the collar distal end, and a transition portion distal end opposite the transition portion proximal end. The transition portion extends laterally outwardly relative to the collar axis from the transition portion proximal end to the transition portion distal end, and the transition portion distal end includes spaced first and second lateral sections joined by spaced first and second transverse sections. The first and second lateral sections and the first and second transverse sections of the transition portion distal end lie in a virtual transition portion distal end plane, and the virtual transition portion distal end plane intersects the collar axis at an oblique angle.

The method 500 further includes, at block 504, forming a first arm. The first arm includes a first arm proximal end coupled to the first lateral section of the transition portion distal end, a first arm distal end spaced from the first arm proximal end, a first dipper pin lug disposed adjacent the first arm distal end, and a first pitch brace lug located intermediate the first arm proximal end and the first arm distal end.

The method 500 continues, at block 506, with forming a second arm. The second arm includes a second arm proximal end coupled to the second lateral section of the transition portion distal end, a second arm distal end spaced from the second arm proximal end, a second dipper pin lug disposed adjacent the second arm distal end, and a second pitch brace lug located intermediate the second arm proximal end and the second arm distal end.

In some examples of the method 500, the first lateral section of the transition portion distal end defines a first interface surface configured for coupling to the first arm, and the second lateral section of the transition portion distal end defines a second interface surface configured for coupling to the second arm. In these examples, forming the first dipper pin lug comprises forging a first dipper pin lug component independent of the first arm, and forming the second dipper pin lug comprises forging a second dipper pin lug component formed independent of the second arm.

In additional examples of the method 500, the first arm includes a first arm proximal section including the first arm proximal end, and a first arm distal section coupled to the first arm proximal section and including the first arm distal end, and the second arm includes a second arm proximal section including the second arm proximal end, and a second arm distal section coupled to the second arm proximal end and including the second arm distal end. In these examples, the first arm proximal section and the second arm proximal section may be forged integrally with the transition component.

In still further examples of the method 500, the first arm and the second arm are forged integrally with the transition component to provide a monolithic yoke component.

Figure 17:
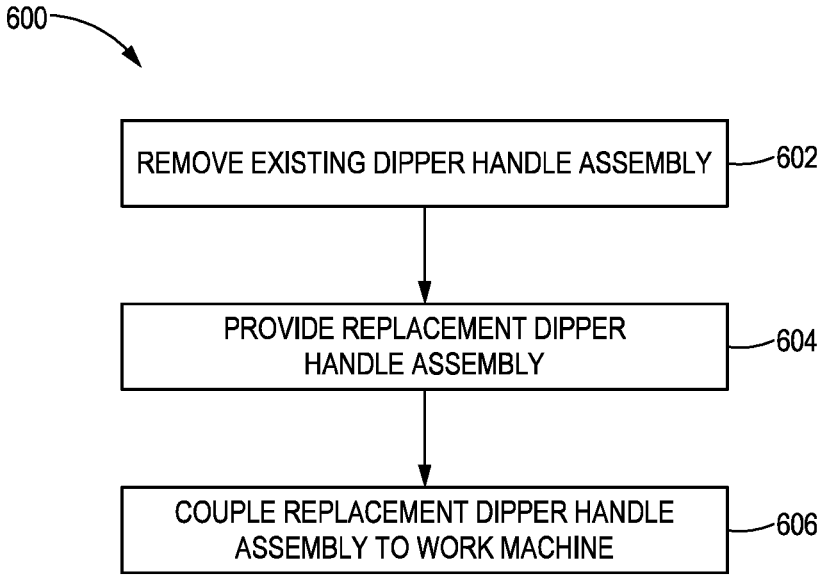
FIG. 17 is a schematic block diagram of a method of retrofitting a work machine having an existing dipper handle assembly with a replacement dipper handle assembly.

FIG. 17 depicts a method 600 of retrofitting a work machine, having an existing dipper handle assembly, with a replacement dipper handle assembly. The method 600 may include all, or some, of the operations disclosed in Caterpillar Service Information System Document No. M0069644-44, which covers dipper handle removal and installation for both a hydraulically operated crowd and a rope operated crowd. The method 600 begins at block 602 with removing the existing dipper handle assembly.

At block 604, the method 600 includes providing the replacement dipper handle assembly with a tube and a yoke coupled to the tube. The yoke includes a collar extending along a collar axis, wherein a crowd pin aperture extends through the collar along a crowd pin aperture axis normal to the collar axis, a transition portion coupled to the collar, a first arm comprising a first arm proximal end coupled to the transition portion and a first arm distal end spaced from the first arm proximal end, a first dipper pin lug disposed adjacent the first arm distal end and defining a first dipper pin lug aperture, and a first pitch brace lug located intermediate the first arm proximal end and the first arm distal end and defining a first pitch brace lug aperture. The yoke further includes a second arm comprising a second arm proximal end coupled to the transition portion and a second arm distal end spaced from the second arm proximal end, wherein the second arm is spaced from the first arm, a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis, and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis. A first virtual reference line extends between the crowd pin aperture axis and the dipper pin aperture axis, and a second virtual reference line extends between the crowd pin aperture axis and the pitch brace aperture axis. An included angle α between the first virtual reference line and the second virtual reference line is between approximately 25 to approximately 51 degrees.

The method 600 further includes, at block 606, coupling the replacement dipper handle assembly to the work machine.

In some examples of the method 600, the included angle α is approximately 33 to approximately 43 degrees. In additional examples of the method 600, the included angle α is approximately 38 degrees.

In still further examples of the method 600, a third virtual reference line intersects the pitch brace aperture axis and is perpendicular to the first virtual reference line, with the third virtual reference line intersecting the first virtual reference line at a point P. In these examples, a distance D between the crowd pin aperture axis and the point P may be between approximately 520 and 1420 millimeters.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A dipper handle assembly, comprising:

a tube; and a yoke coupled to the tube, the yoke comprising:

a collar extending along a collar axis, wherein a crowd pin aperture extends through the collar along a crowd pin aperture axis normal to the collar axis;

a transition portion coupled to the collar, the transition portion extends outwardly from the collar at an oblique angle to distribute operational load stresses;

a first arm comprising a first arm proximal end coupled to the transition portion and a first arm distal end spaced from the first arm proximal end;

a first dipper pin lug disposed adjacent the first arm distal end and defining a first dipper pin lug aperture;

a first pitch brace lug located intermediate the first arm proximal end and the first arm distal end and defining a first pitch brace lug aperture; and a second arm comprising a second arm proximal end coupled to the transition portion and a second arm distal end spaced from the second arm proximal end, wherein the second arm is spaced from the first arm;

a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis; and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis; and wherein:

a first virtual reference line extends between the crowd pin aperture axis and the dipper pin aperture axis;

a second virtual reference line extends between the crowd pin aperture axis and the pitch brace aperture axis; and an included angle α between the first virtual reference line and the second virtual reference line is between approximately 25 to approximately 51 degrees.

2. The dipper handle assembly of claim 1, in which the included angle α is approximately 33 to approximately 43 degrees.

3. The dipper handle assembly of claim 1, in which the included angle α is approximately 38 degrees.

4. The dipper handle assembly of claim 1, wherein:

a third virtual reference line intersects the pitch brace aperture axis and is perpendicular to the first virtual reference line, the third virtual reference line intersecting the first virtual reference line at a point P; and a distance D between the crowd pin aperture axis and the point P is between approximately 520 and 1420 millimeters.

5. The dipper handle assembly of claim 4, wherein the distance D is between approximately 820 and approximately 1020 millimeters.

6. The dipper handle assembly of claim 4, wherein the distance D is approximately 920 millimeters.

7. The dipper handle assembly of claim 1, wherein:

the collar and transition portion are integrally provided as a transition component;

a first lateral section of a transition portion distal end defines a first interface surface configured for coupling to the first arm; and a second lateral section of the transition portion distal end defines a second interface surface configured for coupling to the second arm.

8. The dipper handle assembly of claim 7, wherein:

the first dipper pin lug comprises a first dipper pin lug component formed independent of the first arm;

the second dipper pin lug comprises a second dipper pin lug component formed independent of the second arm; and each of the transition component, first dipper pin lug component, and second dipper pin lug component comprises forged metal.

9. The dipper handle assembly of claim 1, wherein the collar, transition portion, first arm, and second arm are integrally provided as a yoke component comprising a forged metal.

10. The dipper handle assembly of claim 1, wherein:

an end of the tube includes a tube exterior surface defining a tube exterior surface chamfer, and a tube interior surface including a tube root extension extending inwardly toward the collar axis;

an end of the collar abutting the end of the tube includes a collar exterior surface defining a collar exterior surface chamfer, and a collar interior surface including a collar root extension extending inwardly toward the collar axis; and wherein the end of the tube is joined to the end of the collar by a weld disposed in the tube exterior surface chamfer and the collar exterior surface chamfer.

11. A work machine, comprising:

a base configured to be supported on a ground surface;

a revolving frame coupled to the base and rotatable about an axis;

a boom pivotally coupled to the revolving frame;

a dipper handle assembly pivotally coupled to the boom, the dipper handle assembly comprising;

a tube; and a yoke coupled to the tube, the yoke comprising:

a collar extending along a collar axis, wherein a crowd pin aperture extends through the collar along a crowd pin aperture axis normal to the collar axis;

a transition portion coupled to the collar, the transition portion extends outwardly from the collar at an oblique angle to distribute operational load stresses;

a first arm comprising a first arm proximal end coupled to the transition portion and a first arm distal end spaced from the first arm proximal end;

a first dipper pin lug disposed adjacent the first arm distal end and defining a first dipper pin lug aperture;

a first pitch brace lug located intermediate the first arm proximal end and the first arm distal end and defining a first pitch brace lug aperture; and a second arm comprising a second arm proximal end coupled to the transition portion and a second arm distal end spaced from the second arm proximal end, wherein the second arm is spaced from the first arm;

a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis; and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis; and wherein:

a first virtual reference line extends between the crowd pin aperture axis and the dipper pin aperture axis;

a second virtual reference line extends between the crowd pin aperture axis and the pitch brace aperture axis; and an included angle $\alpha$ between the first virtual reference line and the second virtual reference line is between approximately 25 to approximately 51 degrees.

12. The work machine of claim 11, in which the included angle $\alpha$ is approximately 33 to approximately 43 degrees.

13. The work machine of claim 11, in which the included angle $\alpha$ is approximately 38 degrees.

14. The work machine of claim 11, wherein:

a third virtual reference line intersects the pitch brace aperture axis and is perpendicular to the first virtual reference line, the third virtual reference line intersecting the first virtual reference line at a point P; and a distance D between the crowd pin aperture axis and the point P is between approximately 520 and 1420 millimeters.

15. The work machine of claim 14, wherein the distance D is between approximately 820 and approximately 1020 millimeters.

16. The work machine of claim 14, wherein the distance D is approximately 920 millimeters.

17. A method of retrofitting a work machine having an existing dipper handle assembly with a replacement dipper handle assembly, the method comprising:

removing the existing dipper handle assembly;

providing the replacement dipper handle assembly with:

a tube; and a yoke coupled to the tube, the yoke comprising:

a collar extending along a collar axis, wherein a crowd pin aperture extends through the collar along a crowd pin aperture axis normal to the collar axis;

a transition portion coupled to the collar, the transition portion extends outwardly from the collar at an oblique angle to distribute operational load stresses;

a first arm comprising a first arm proximal end coupled to the transition portion and a first arm distal end spaced from the first arm proximal end;

a first dipper pin lug disposed adjacent the first arm distal end and defining a first dipper pin lug aperture;

a first pitch brace lug located intermediate the first arm proximal end and the first arm distal end and defining a first pitch brace lug aperture; and a second arm comprising a second arm proximal end coupled to the transition portion and a second arm distal end spaced from the second arm proximal end, wherein the second arm is spaced from the first arm;

a second dipper pin lug disposed adjacent the second arm distal end and defining a second dipper pin lug aperture, wherein the first dipper pin lug aperture and the second dipper pin lug aperture are aligned along a dipper pin aperture axis extending parallel to the crowd pin aperture axis; and a second pitch brace lug located intermediate the second arm proximal end and the second arm distal end and defining a second pitch brace lug aperture, wherein the first pitch brace lug aperture and the second pitch brace lug aperture are disposed along a pitch brace aperture axis extending parallel to the crowd pin aperture axis; and wherein:

a first virtual reference line extends between the crowd pin aperture axis and the dipper pin aperture axis;

a second virtual reference line extends between the crowd pin aperture axis and the pitch brace aperture axis; and an included angle $\alpha$ between the first virtual reference line and the second virtual reference line is between approximately 25 to approximately 51 degrees; and coupling the replacement dipper handle assembly to the work machine.

18. The method of claim 17, in which the included angle $\alpha$ is approximately 33 to approximately 43 degrees.

19. The method of claim 17, in which the included angle $\alpha$ is approximately 38 degrees.

20. The method of claim 17, wherein:

a third virtual reference line intersects the pitch brace aperture axis and is perpendicular to the first virtual reference line, the third virtual reference line intersecting the first virtual reference line at a point P; and a distance D between the crowd pin aperture axis and the point P is between approximately 520 and 1420 millimeters.

* * * * *